United States Patent [19]

Lindae et al.

[11] Patent Number: 4,607,318

[45] Date of Patent: Aug. 19, 1986

[54] HEADLAMP, PARTICULARLY ANTIDAZZLE HEADLAMP FOR MOTOR VEHICLES

[75] Inventors: Gerhard Lindae, Leonberg; Peter Perthus, Stuttgart; Heinz Rein, Reutlingen, all of Fed. Rep. of Germany

[73] Assignee: Robert Bosch GmbH, Stuttgart, Fed. Rep. of Germany

[21] Appl. No.: 681,211

[22] Filed: Dec. 12, 1984

[30] Foreign Application Priority Data

May 9, 1984 [DE] Fed. Rep. of Germany ..... 3417034

[51] Int. Cl.[4] ..... F21M 3/30

[52] U.S. Cl. ..... 362/307; 362/309

[58] Field of Search ..... 362/307, 296, 297, 308, 362/309, 347, 350, 346, 375, 310

[56] References Cited

U.S. PATENT DOCUMENTS

| | | | |
|---|---|---|---|
| 1,969,714 | 8/1934 | Burger | 362/307 |
| 2,089,927 | 8/1937 | Stechert | 362/307 |
| 3,259,776 | 7/1966 | Wallace | 362/307 |
| 3,428,800 | 2/1969 | Lavin et al. | 362/309 |
| 3,431,449 | 3/1969 | Hundley | 362/309 |
| 3,553,520 | 1/1971 | Hicks | 362/307 |
| 3,908,144 | 9/1975 | Rudd | 362/307 |
| 4,420,801 | 12/1983 | Reiling et al. | 362/307 |
| 4,451,873 | 5/1984 | Tyler et al. | 362/307 |
| 4,462,067 | 7/1984 | Altman | 362/307 |
| 4,480,296 | 10/1984 | Gagnon et al. | 362/307 |

OTHER PUBLICATIONS

Sealed Beam Headlamp Units for Motor Vehicles—SAE J579c, (as mentioned on p. 2 of the specification) Jan. 1940.

*Primary Examiner*—Raymond A. Nelli

*Attorney, Agent, or Firm*—Michael J. Striker

[57] ABSTRACT

A headlamp emitting dimmed or antidazzle light beam for motor vehicles, includes a paraboloid reflector including a transversely arranged coiled heating filament and a transparent grooved disc for diffusing or refracting light emitted by the reflector. The light means include eight light refracting fields arranged in diametrically opposed parts. Light rays passing through these fields are emitted from predetermined zones on the reflector so as to produce an improved light distribution of the low beam.

5 Claims, 1 Drawing Figure

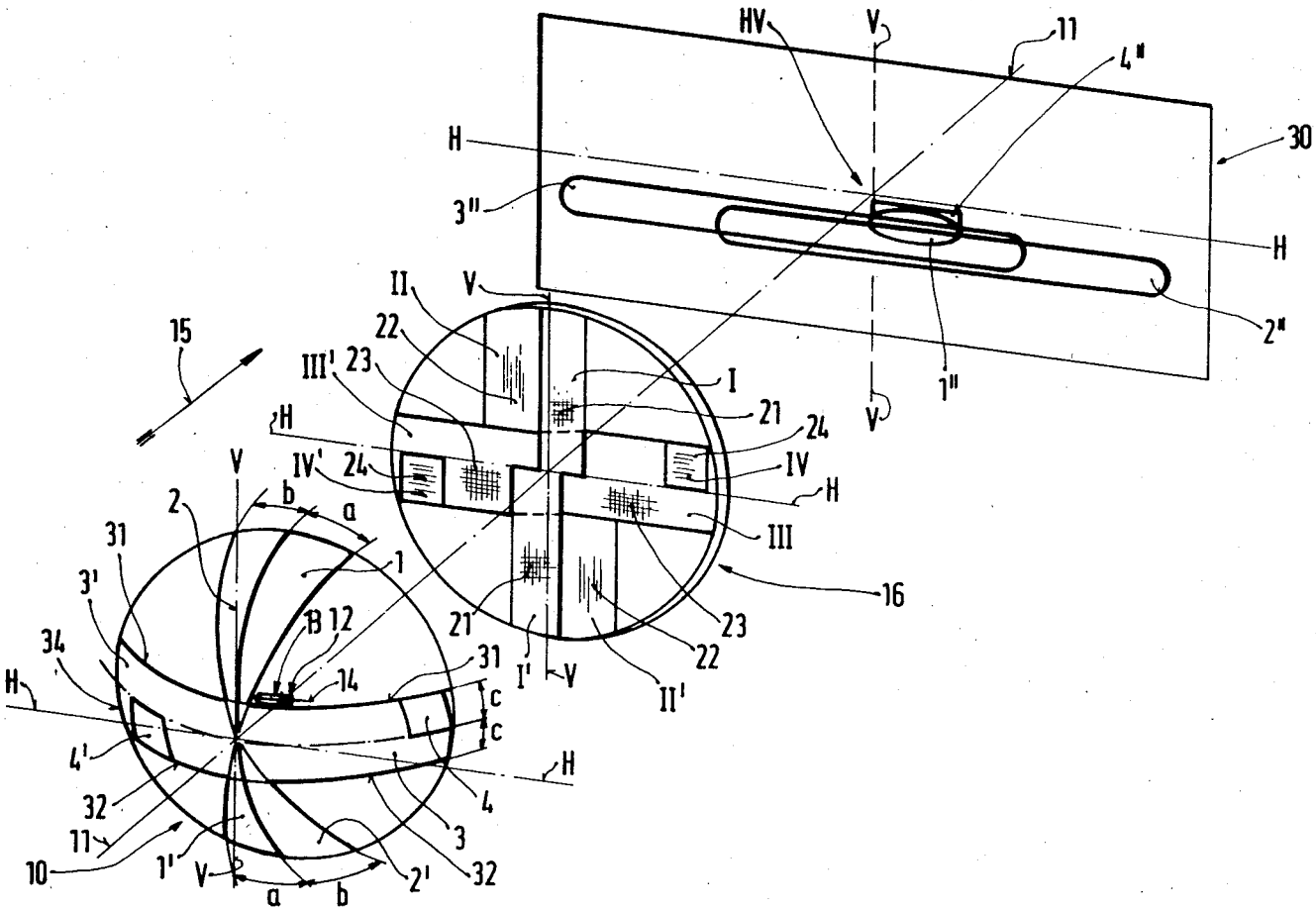
30
H
2"
4"
11
1"
V
V
HV
3"
H
16
24
IV
H
III
21
I
23
22
II'
V
1'
27
II
22
23
III'
24
IV'
H
31
c
c
4
3
32
2'
1
14
B 12
a
b
V
2
15
31
3'
34
4'
32
11
10
H
1'
V
a
b

HEADLAMP, PARTICULARLY ANTIDAZZLE HEADLAMP FOR MOTOR VEHICLES

BACKGROUND OF THE INVENTION

The present invention relates in general to a headlamp for motor vehicles and in particular to an antidazzle headlamp having a reflector in the form of a rotational paraboloid, a coiled up incandescent filament whose horizontal axis is transverse to the axis of the reflector and whose geometric center point is located off the center point of the reflector, a transparent disc arranged in the path of the light beam reflected from the reflector and being provided with optical means which transform the emitted light beam into an antidazzle light beam.

Headlamps of this kind permissible in U.S.A. must produce an antidazzle light beam in accordance with the light distribution prescribed by SAEG 579(c). The antidazzle light beam need not exhibit any light-dark boundary having a distinct sharp upper edge, as required by European regulations. Advantages resulting from the latter standards, such as reduced blinding of drivers approaching from counterdirection, a more accurate adjustment of the headlight and primarily a more advantageous effect on perceptibility conditions, are lacking in the U.S. standard of the light beam.

SUMMARY OF THE INVENTION

It is therefore a general object of the present invention to overcome the aforementioned disadvantages.

More particularly, it is an object of the invention to provide such a distribution of light in the headlamp of the aforedescribed kind which provides a noticeable improvement of the antidazzle light beam.

An additional object of the invention is to provide such an improved headlight which provides a distinct demarkation between light-dark thus increasing particularly the perceptibility conditions for the driver.

In keeping with these objects and others which will become apparent hereafter, one feature of the invention resides, in an antidazzle headlight of the above-described kind, in a combination which comprises the distribution of optical reflecting means in the transparent disc of the reflector in a set of diametrically opposed reflecting fields I to III and I' to III' arranged as follows with respect to a vertical coordinate V and a horizontal coordinate H intersecting each other at right angles at a center point of the disc and viewed in the direction of propagation of the light beam:

a. Field I is substantially to the right of V and above H, field I' is substantially to the left of V and below H, the fields I and I' being designed to reflect a partial light beam on an illuminated area without sharp contrast edges;

b. Field III is to the right of fields I and I', field III' is to the left of the fields I and I' and both fields III, III' extend at both sides of H and retract light in vertical and horizontal directions; and c. Field II is to the left of field I and above field III', field II' is to the right of field I' and below field III, and retracts light in vertical and horizontal directions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE shows schematically, in an exploded perspective view, a reflector, its transparent disc and a measuring screen with indicated partial light beams constituting the antidazzle light beam.

DESCRIPTION OF THE PREFERRED EMBODIMENT

An antidazzle headlamp according to U.S.A. regulations SAE 59c illustrated in a rear view in the drawing includes a reflector 10 in the form a rotational paraboloid defining a central axis 11, and a focal point 12. Before the focal point, when viewed in the direction of light propagation, there is arranged a coiled up heated filament 13 whose longitudinal axis 14 extends in horizontal direction transversely (at right angles) to the central axis 11 whereby the center point of the filament coil is off the focal point 12. In the FIGURE, a left hand shift of the center point relative to the focal point (defocussing to the left) for a right hand traffic is illustrated. If it is desired to switch over from a low beam (antidazzle or dimmed light) to a high beam, then the corresponding (non-illustrated) coiled filament is located below the coiled filament 13. In the FIGURE there are also indicated imaginary horizontal and vertical coordinates HH and VV forming together and to the center axis 11 right angles.

A transparent light diffusing or reflecting disc 16 is arranged in the path of light rays reflected from the reflector 10 in the direction of propagation 15. The transparent disc 16 is provided with optical means 21 through 24 arranged in fields or portions I through IV and I' to IV' of the optical means whereby light rays reflected from zones 1 to 4 and 1' to 4' of the reflector 10 pass through these fields. A measuring screen 30 is arranged at a certain distance from the transparent disc 16 at right angles to the center axis 11 of the reflector. The center axis 11 passes through the center points of the reflector 10, of the rectangular coordinates HH, VV of the transparent disc 16 and through the measuring shield 30. When the illustrated coiled filament 13 is switched on, four partial beams 1'' through 4'', forming together the dimmed or antidazzle light beam, illuminate the measuring shield 30 to the right and below the intersection point of HH,VV.

According to this invention, the spatial and functional arrangement of the optical retracting fields is as follows:

Field I is substantially to the right of VV and above HH, and the field I' is substantially to the left of VV and below HH; the optical means 21 of the fields I and I' refract light rays which form partial beam 1'' (a hot spot) in such a manner that the partial beam 1'' is flattened and has edges without any sharp contrasts, light rays reflected from the center or zone 1 of the reflector pass through the field I and light rays reflected from the sector (zone) 1' pass through the field I' whereby the angle of the sectors 1 and 1' is at most 40°, preferably 30°.

Field III is to the right of fields I, I' and both fields I, I' are arranged on either side of the horizontal coordinate H; the optical means 23 in the fields I, I' refract the light rays forming the partial beam 3'' both in the horizontal and in the vertical direction. Light rays reflected from the zone 3 of the reflector pass through the field III, and light rays from the zone 3' pass through the field III' whereby the clearance c of the upper or lower boundary edge 31 or 32 of the two zones 3, 3' from the horizontal coordinate H amounts maximum to 30 mm, preferably 20 mm.

Field II is to the left of the field I and above the field III', and the field II' is to the right of the field I' and below the field III, whereby the optical means 22 refract the light rays forming the partial light beam 2'' both in the horizontal and in the vertical direction. Light rays reflected from the sector (zone) 2, pass through the field II and light rays from the sector (zone) 2' pass through the field II' whereby the angle b of the sectors 2, 2' is maximum 50°, preferably 40°.

Field IV adjoins an upper edge portion of the field III, and the field IV' adjoins the lower edge portion of the field III'; optical means refracting light rays forming the partial light beam 4'' are designed such as to produce a sharp boundary edge of the partial light beam 4'' with the upper left region of the partial light beam 1''. Light rays passing through the fields IV and IV' are those reflected from the sectors (zones) 4 and 4', respectively, whereby the upper edge of the zone 4' and the lower edge of the zone 4 coincide with the horizontal coordinate H, and the lower edge of the zone 4' and the upper edge of the zone 4 coincide respectively with the boundary lines 32 and 31 pertaining to the zones 3, 3'. The outer, vertical boundary line of the zones 4', 4 is formed marginal portion 34 of the reflector 10 and the breadth of both zones 4', 4 is maximum 60 mm, preferably 30 mm. Optical means 21 through 24 in fields I through IV and I' through IV' include prisms which deflect light in vertical direction, and also include lenses which deflect light in horizontal direction whereby the effect of the prisms is combined with the effect of the lenses.

The partial light beam 2'' illuminates the center and the right hand edge of the highway; the partial light beam 3'' illuminates the center and the left hand edge of the highway; and the partial light beam 4'' is superposed to the partial light beam 1'' and limits its upper left hand range, thus facilitating the adjustment of the entire antidazzle or dimmed light beam.

The remaining fields of the transparent disc 16, if desired can be also provided with optical means for achieving additional effects on the light distribution of the dimmed light beam.

It will be understood that each of the elements described above, or two or more together, may also find a useful application in other types of constructions differing from the types described above.

While the invention has been illustrated and described as embodied in a paraboloid reflector having a circular base and designed for right hand traffic, it is not intended to be limited to the details shown, since various modifications and structural changes may be made without departing in any way from the spirit of the present invention. For example, when a rectangular reflector is used, the structural distribution of the aforedescribed zones of the reflector and the distribution of the optical fields in the glass plate are approximately the same as described before; for a left hand traffic the sides of the zones and optical fields are correspondingly reversed.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A headlamp, particularly an antidazzle headlamp for motor vehicles, having a reflector in the form of a rotational paraboloid defining a center axis and a focal point on the center axis; a coiled up incandescent filament defining a longitudinal axis extending in horizontal direction at right angles to the center axis of the reflector and having a center point situated off said focal point; a transparent disc arranged in the path of a light beam reflected from the reflector; optical means provided in the range of the transparent disc to transform the emitted light beam into an antidazzle light beam extending along an axis of propagation; said optical means including a set of diametrically opposed refracting portions I through III and I' through III' arranged with respect to a vertical coordinate V and to a horizontal coordinate H intersecting each other and said center axis of the reflector at right angles, and viewed in direction of propagation of the light beam, as follows:

the portion I of the optical means is substantially to the right of V and above of H, the portion I' being substantially to the left of V and below H, the portions I and I' of the optical means being designed such as to refract a partial light beam without any sharp contrast at the envelope; of the partial light beam;

the portion III is to the right of the portions I and I', the portion III' is to the left of the portions I and I', both portions III, III' extending at both sides of the corresponding part of H and refracting the light rays in vertical and horizontal direction; and the portion II is to the left of the portion I and above the portion III', the portion II' is to the right of the portion I' and below the portion III, and portions II, II' of the optical means refracting the light rays in vertical and horizontal directions.

2. A headlamp as defined in claim 1 wherein said incandescent filament is located before said focal point when viewed in the direction of light propagation, and said center point of the filament being off said center axis.

3. A headlamp as defined in claim 1, wherein the optical means further include a portion IV adjoining an upper edge part of the portion III, and portion IV' adjoining a lower edge part of the portion III', the portions IV, IV' of the optical means refracting the light rays such as to sharply delimit the upper left hand range of the partial light beam passing through the portions I and I'.

4. A headlamp as defined in claim 1, wherein said portions of the optical means include prisms reflecting light rays in vertical direction and lenses reflecting light rays in horizontal direction, whereby the effects of the prisms combine with the effects of the lenses.

5. A headlamp as defined in claim 3, wherein light reflecting zones 1 to 4 and 1' to 4' of the reflector emitting light through the corresponding portions I through IV and I' through IV' of the optical means are arranged as follows:

(a) zone 1 reflecting light rays through the portion I and zone 1' reflecting light rays through the portion I' each have the configuration of a paraboloid sector forming an angle of maximum 40°, preferably 30°;

(b) zones 2 and 2' reflecting light through the portions II and II' respectively have the form of paraboloid sectors each forming an angle of maximum 50°, preferably 40°;

(c) zones 3 and 3' reflecting light rays through the portions III, III' have the form of rectangular segments whose upper or lower edge is spaced apart from the horizontal coordinate H maximum 30 mm, preferably 20 mm; and (d) zones 4, 4' reflecting light rays through the portions IV, IV' have respectively square configurations and being delimited respectively by an edge part of the reflector, a lower edge part of the zone 4' and by an upper edge part of the zone 4, each zone 4, 4' adjoining a part of the horizontal coordinate H and having a maximum breadth of 60 mm, preferably 30 mm.

* * * * *